United States Patent [19]

Cribb et al.

[11] Patent Number: 4,948,440

[45] Date of Patent: Aug. 14, 1990

[54] EMULSION BLASTING AGENT PREPARATION SYSTEM

[75] Inventors: William E. Cribb, Point Claire; John R. Chiles, Thornhill, both of Canada; William B. Evans, Gosford, Australia; Ralph H. Derry, Otterburn Park, Canada

[73] Assignee: C-I-L Inc., North York, Ontario, Canada

[21] Appl. No.: 252,538

[22] Filed: Oct. 3, 1988

[30] Foreign Application Priority Data

Oct. 5, 1987 [CA] Canada ..... 548645

[51] Int. Cl.[5] ..... D03D 23/00

[52] U.S. Cl. ..... 149/109.6; 149/2

[58] Field of Search ..... 149/2, 109.6

[56] References Cited

U.S. PATENT DOCUMENTS

| | | | |
|---|---|---|---|
| 846,872 | 3/1907 | Stewart | 259/107 |
| 945,131 | 1/1910 | Mallory | 259/107 |
| 2,179,271 | 11/1939 | Pick | 259/107 |
| 2,515,555 | 7/1950 | Gratias | 254/149 |
| 2,559,516 | 7/1951 | Russell | 259/6 |
| 2,563,937 | 8/1951 | Keight et al. | 259/9 |
| 2,626,786 | 1/1953 | McGlothlin | 259/8 |
| 3,180,627 | 4/1965 | Belonga | 259/107 |
| 3,438,742 | 4/1969 | Grunewald et al. | 23/285 |
| 3,940,116 | 2/1976 | Verlinder et al. | 259/45 |
| 4,138,281 | 2/1979 | Olney et al. | 149/2 |
| 4,472,215 | 9/1984 | Binet et al. | 149/109.6 |
| 4,491,489 | 1/1985 | Ellis et al. | 149/109.6 |
| 4,526,633 | 7/1985 | Lawrence et al. | 149/109.6 |

*Primary Examiner*—Stephen J. Lechert, Jr.
*Attorney, Agent, or Firm*—C. Brian Barlow

[57] ABSTRACT

The invention provides an apparatus for the manufacture of a coarse emulsion blasting agent and a method for the conversion of same into a sensitive blasting explosive. The apparatus comprises a low shear mechanical mixer in which a coarse emulsion can be continuously prepared. The coarse emulsion is then passed though a fine emulsification motionless mixer for conversion into sensitive explosive.

4 Claims, 2 Drawing Sheets

EMULSION BLASTING AGENT PREPARATION SYSTEM

The present invention relates to an apparatus and method for the continuous manufacture of an emulsified water-in-oil precursor for emulsion explosives. In particular, the invention relates to an apparatus for use in the continuous production of an emulsified precursor for emulsion explosives. By explosive emulsion precursor is meant a composition which is substantially insensitive to initiation except by strong boostering but which can be converted into a useful and often cap-sensitive explosive by further refinement and the lowering of its density by, for example, the inclusion therein of minute gas bubbles or particulate void-containing material such as glass or resin microspheres.

Water-in-oil emulsion explosives are now well known in the explosives art and have been demonstrated to be safe, economic and simple to manufacture and to yield excellent blasting results. Bluhm, in U.S. Pat. No. 3,447,978, disclosed an emulsion explosive composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-oil explosives compositions. These include U.S. Pat. No. 3,674,578, Cattermole et al.; U.S. Pat. No. 3,770,522, Tomic; U.S. Pat. No. 3,715,247, Wade; U.S. Pat. No. 3,675,964, Wade; U.S. Pat. No. 4,110,134, Wade; U.S. Pat. No. 4,149,916, Wade; U.S. Pat. No. 4,141,917, Wade; U.S. Pat. No. 4,141,767, Sudweeks & Jessup; Canadian Patent No. 1,096,173, Binet & Seto; U.S. Pat. No. 4,111,727, Clay; U.S. Pat. No. 4,104,092, Mullay; U.S. Pat. No. 4,231,821, Sudweeks & Lawrence; U.S. Pat. No. 4,218,272, Brockington; U.S. Pat. No. 4,138,281, Olney & Wade; U.S. Pat. No. 4,216,040, Sudweeks & Jessup.

Emulsion explosive compositions have, in most instances, been manufactured in commercial quantities by means of batch processes employing conventional high-shear mixing apparatus. Generally, the prior art has not been specific in suggesting any particular mixing or emulsifying apparatus or techniques, references usually being made merely to "agitation" or "mixing" or "blending" of the aqueous phase and the oil phase in the presence of an emulsifier. Cattermole et. al., in U.S. reissue No. 28060, refer to the use of a turbine mixer. Chrisp, in U.S. Pat. No. 4,008,108, refers to a high-shear mixer, that is, a shear pump. Olney, in U.S. Pat. No. 4,138,281, suggests the possible use of a continuous recycle mixer, for example, the VOTATOR (Reg TM) mixer, an in-line mixer, for example, the TURBON (Reg TM) and a colloid type mixer, for example, the OAKES (Reg TM). In U.S. Pat. No. 4,526,633, Lawrence et al discloses a blender apparatus having shaft-mounted internal high-shear mixing blades. In Canadian Patent No. 1,186,152, the use of in-line mixers and a recirculating system is disclosed.

It is self-evident that in the manufacture of any sensitive explosive material, the use of mechanical mixers with the ever-present risk of breakdown and impact should preferably be avoided. In addition, the generation of heat by any high-shear mechanical mixing device produces additional hazard. Furthermore, with high-shear mechanical mixers production rates are generally limited and, often, capital investment is high.

Applicants have now found that a conventional in-line static mixer or an equivalent motionless mixer can be employed for the efficient production of a highly viscous and stable high phase ratio explosive emulsion when it is combined with a low-shear mechanical mixer as will hereinafter be described.

By "in-line static mixer" is meant a hollow, generally tubular element containing one or more stationary, perforated or slotted elements which achieve mixing by dividing and sub-dividing a fluid flow passing therethrough. Typical of such static mixers is, for example, the SULZER mixer manufactured by Sulzer Brothers Limited of Switzerland. By high phase ratio water-in-oil emulsion is meant an emulsion composition wherein the amount of the dispersed aqueous phase comprises at least 90% by weight of the total compositions and may comprise as much as 95% by weight or more of the total composition.

By employing an emulsion explosive manufacturing process comprising a conventional in-line static or equivalent motionless mixer in combination with a low-shear mechanical mixer, applicants have found that the continuous production of high phase ratio emulsions can be achieved without any of the inherent disadvantages of prior art methods.

In order to provide a better understanding of the invention, reference is made the the accompanying drawings in which.

Figure 1:
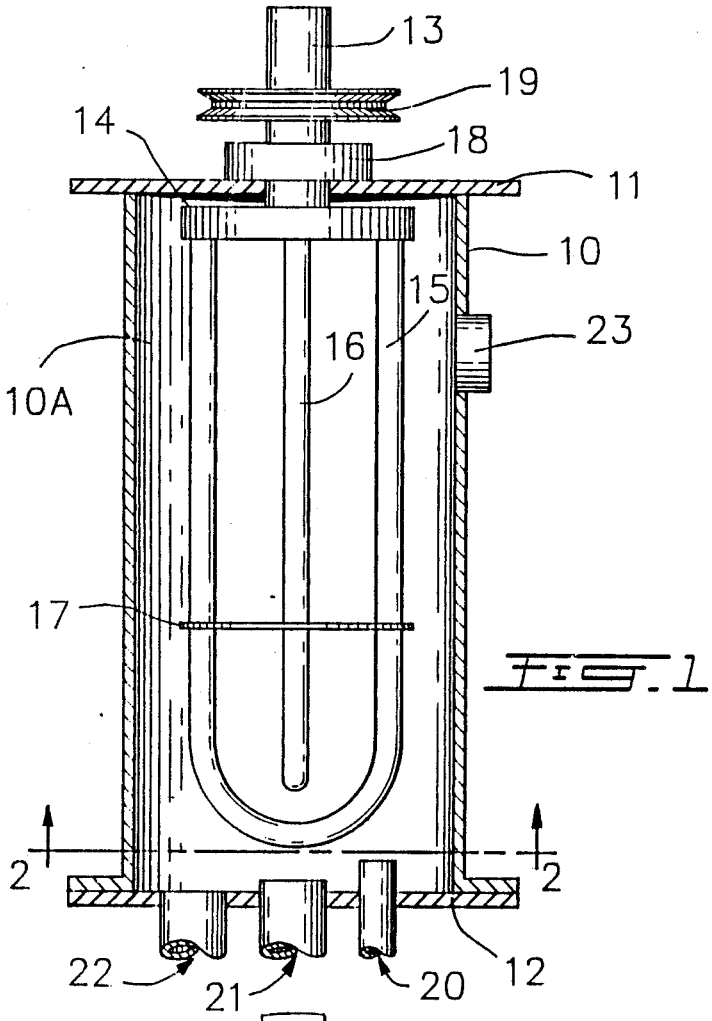
FIG. 1 shows a vertical section of the novel low-shear mixer of the invention.
Figure 2:
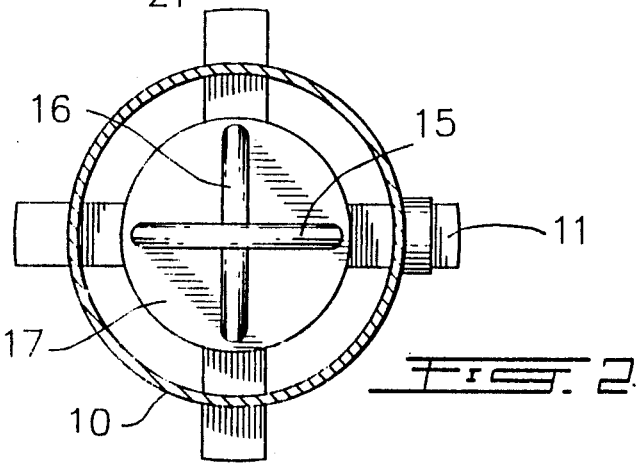
FIG. 2 shows a cross-sectional view of the mixer of FIG. 1 taken along the line 2—2.

Referring to FIGS. 1 and 2, where similar reference numerals refer to similar parts, a vertical cylindrical tube 10 describing a tank-like mixing chamber 10A is shown having an upper flange or crossbar 11 and a lower closing end flange or plate 12. A bearing 18 is supported on flange or crossbar 11. Mounted passing through bearing 18 is a rotatable shaft 13 to which is fixed a support disc 14. Attached to disc 14 and extending downward towards lower plate 12 is a cylindrical U-shaped tube or rod element 15. A similar shortened cylindrical U-shaped element 16 is mounted on disc 14 at right angles to the plane of rod element 15. An optional stabilizing cross-shaped spider or a perforated disc 17 is shown fixed to elements 15 and 16 close to their lower ends. Elements 15 and 16 comprise the agitator of the apparatus. Shaft 13, supported in bearing 18, is adapted for rotation by, for example, a drive pulley 19. Located passing through lower end plate 12 and entering the mixing chamber 10A are tubular fluid inlets 20 and 21 and a drain outlet 22. One or more overflow or product outlet openings 23, are provided in the side wall upper segment of mixing chamber 10A.

The mixer of FIGS. 1 and 2 blends an aqueous inorganic salt solution (the aqueous phase) and a liquid organic fuel plus emulsifier (the oil phase) with sufficient shear to form a coarse water-in-oil emulsion. In the operation of the mixer, the oil phase is metered by pump into the mixing chamber 10A through fluid inlet 20 while the mixing blades or elements 15 and 16 are rotated by means of shaft 13 and drive 19. The aqueous phase is then added by metered pump through fluid inlet 21. The continuous flow rates of both the organic fuel component and the salt solution component are adjusted to provide the correct proportion of each phase to form a stable water-in-oil emulsion. The resulting coarse emulsion which is formed in chamber 10A continuously overflows through outlet 23 from which it may be collected for further refinement as will hereinafter be described. A measure of the viscosity of the overflowing coarse emulsion provides a means for adjusting the speed of agitation and rate of inflow of each phase in order to achieve appropriate dwell time within mixing chamber 10A to provide optimum results. Additional dwell time of the emulsion within mixing chamber 10A can be achieved by locating overflow outlet 23 closer to upper flange or crossbar 11. Dwell time may range from 10 seconds to two minutes or more.

Known mechanical emulsifying mixers or blenders used in the manufacture of emulsion explosives comprise agitators which are propellers, pin and stator combinations or turbine-like blades. Such mixers, although generally achieving a desirable high-shear, generate high heat levels and carry the risk of high impact. The agitators of the novel mixer of the present invention provide a gentle emulsifying action because of the rounded configuration of the U-shaped elements 15 and 16. The vertical mounting of mixing chamber 10A provides a drive mechanism which is separated from the product being mixed and eliminates the problem of explosive material entering seals and bearings. The uniform cross-section within the mixing chamber 10A provides uniform agitation over the full height of the column of mixed material and no particular reliance is placed on any vortex to draw surface material downward, as with a propeller type mixer. The agitator speed, through drive 19 may be infinitely adjusted to provide the required emulsion droplet size and viscosity. The agitator design is simple and can be constructed from commercial rod or tubing bent into a U-shape configuration.

The mixing chamber 10A provides product flow upward so that product quality continuously improves from bottom to top as mixing proceeds. The cylindrical shape of chamber 10A in conjunction with judicious selection of the diameter and spacing of agitator elements 15 and 16 ensures that all product flowing upward through the chamber is subjected to adequate mixing to achieve the desired emulsification. The apparatus is compact and may be of the order of 40 cm in diameter and 1.6 m high. Thus it can easily be fitted on a mobile mixer and delivery vehicle.

The material of construction of the mixer chamber 10A and plates 11 and 12 may conveniently be aluminum. In some cases, rigid plastic will suffice. The agitator elements 15 and 16, the drive shaft 13, the mounting plate 14, and support plate 17, are preferably made from stainless steel. The agitator may by driven by any convenient means, for example, an electric motor and variable speed drive or by a hydraulic motor.

Figure 3:
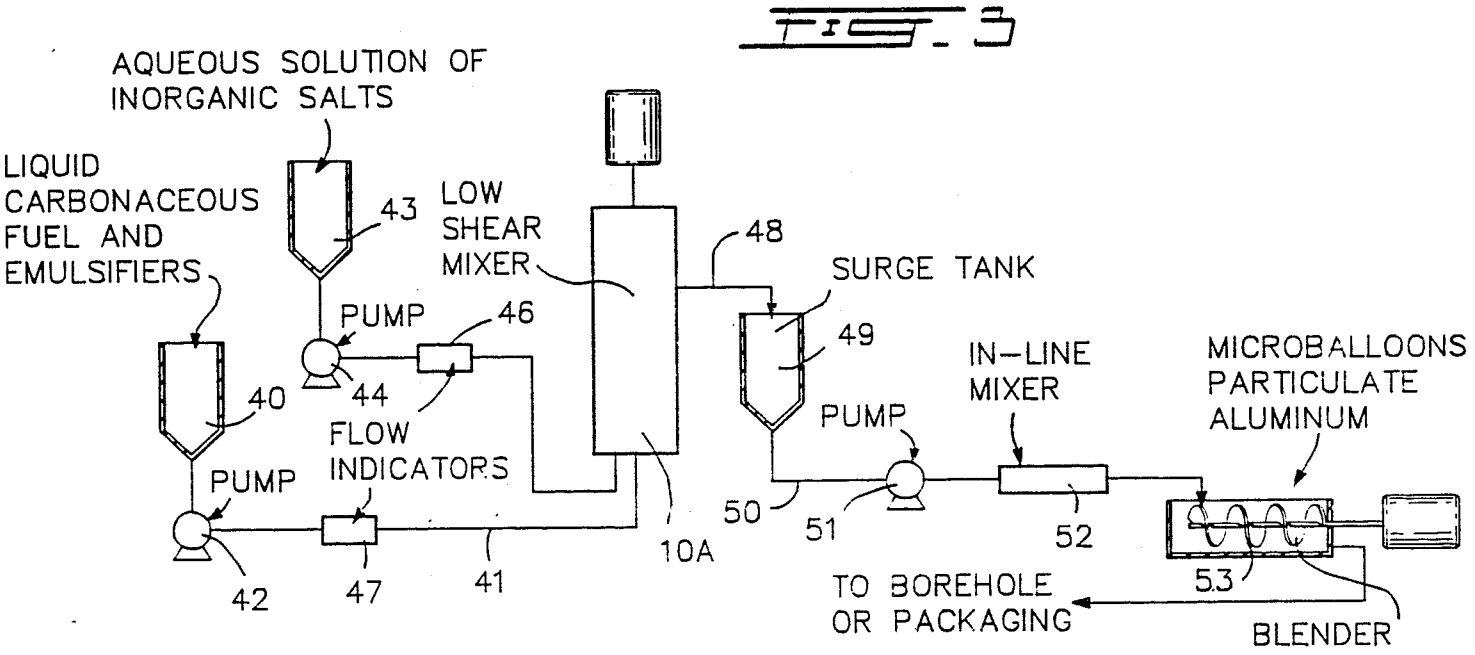
FIG. 3 shows a flow diagram of an emulsion explosive preparation method according to the invention.

The method of preparation of a detonable emulsion explosive composition utilizing the novel low-shear emulsion mixer of the invention will now be described with reference to FIG. 3. The oil or fuel phase of the composition may comprise, for example, a variety of saturated or unsaturated hydrocarbons including petroleum oils, vegetable oils, mineral oils, dinitrotoluene or mixtures of these. Optionally, an amount of a wax may be incorporated in the fuel phase. Such a fuel phase is stored in a holding tank 40 which tank is often heated to maintain fluidity of the fuel phase. The fuel is introduced into low-shear mixer 10A through inlet conduit 41 by means of pump 42. An emulsifier, such as for example sorbitan mono-oleate, sorbitan sesqui-oleate or Alkaterge T (Reg TM) is proportionally added to the fuel phase in holding tank 40. The amount of emulsifier added generally comprises from about 0.4 to 4% by weight of the total composition. An aqueous solution of oxidizer salt containing 70% or more by weight of salts selected from ammonium nitrate, alkali and alkaline earth metal nitrates and perchlorates, amine nitrates or mixtures thereof, is delivered from a heated tank or reservoir 43 by means of pump 44 to low-shear mixer 10A through conduit inlet 45. The aqueous phase is maintained above its fudge point. The rate of flow of the fuel phase and the aqueous phase can be adjusted by observation of flow indicators 46 and 47 so that the resultant mixture is in a desired high phase ratio typically, for example, 94% by weight of the aqueous phase to 6% by weight of the fuel phase. The continuously mixed and emulsified fuel component and salt solution component in low-shear mixer 10A overflows through conduit 48 into surge tank 49 as a coarse emulsion. The emulsified mixture is withdrawn from tank 49 through conduit 50 by pump 51 and is then passed through a fine emulsification mixer 52 for further refinement to produce an emulsion of 4 micron or less droplet size. From mixer 52, the refined emulsion is delivered into blender 53 where the density of the final product is adjusted by the addition of, for example, microballons or other void-containing material. Additional material, such as finely divided aluminum, may also be added in blender 53. From blender 53 the final product, which is a sensitive emulsion explosive, may be delivered to the borehole as a bulk explosive or to a packaging operation.

The fine emulsification mixer 52 employed in the process of the invention may be an in-line static mixer which achieves emulsification by continuous splitting and layer generation and the rearrangement and reunification of the incoming coarse emulsion stream. Suitable static mixers are the SULZER containing some SMV type mixing elements (Koch Engineering Co. Inc. of New York, U.S.A.) or the ROSS containing some ISG mixing elements (Charles Ross and Son Co. of Hauppauge, N.Y., U.S.A.) which static mixing units comprise a number of these stationary elements housed in a pipe. The number and size of the elements can be selected to achieve the desired final product emulsification. Alternatively, fine emulsification may be achieved by pumping the coarse emulsion through an orifice of adjustable size.

The following Examples describe the mixing device of the invention but are not to be interpreted as a limitation in the scope thereof.

EXAMPLE I

A cylindrical low-shear mixer as shown in FIGS. 1 and 2 was constructed of aluminum plate having an internal diameter of 38 cm and having a product outlet 23, 122 cm above its base 12. The agitator elements 15 and 16 were constructed from 2.5 cm round steel rod. With the agitator rotating at a rate of 190 rpm an ammonium nitrate aqueous solution was continuously fed through inlet 21 into the mixer at the rate of 180 kg/min. while an oil/surfactant mixture was continuously fed into the mixer through inlet 20 at the rate of 12 kg/min. The dwell time of the mixture in the mixer was approximately one minute before product overflowed through outlet 23. The overflow emulsion product had a viscosity of 4100 centipoises when measured with a Brookfield No. 6 spindle at 20 rpm. An increase in agitator speed to 320 rpm produced an emulsion having a viscosity of 5000 centipoises. Further refinement of the emulsion through an in-line mixer produced a detonable emulsion explosive having a viscosity of more than 13,000 centipoises.

EXAMPLE II

A low-shear mixer similar to that of Example 1 but having an internal diameter of 46 cm and a product outlet 64 cm above the base, gave a product having a viscosity of 3750 centipoises using an agitator speed of 375 rpm, a dwell time of 80 seconds and a throughput rate of 95 kg/min. Further refinement of the product produced a detonable emulsion explosive having viscosities from 10,000 to 29,000 centipoises.

We claim:

1. A continuous method for the manufacture of a water-in-oil explosive emulsion precursor comprising a discontinuous aqueous oxidizer salt phase and a continuous oil phase comprising the steps of:

(a) forming an oxidizer salt solution;

(b) forming a liquid organic fuel and emulsifier mixture;

(c) proportionally introducing said salt solution and said liquid organic fuel and emulsifier mixture into an emulsifying blender and mixing in order to form a water-in-oil emulsion, the said blender comprising:

(i) a vertical cylindrical tank closed at its upper and lower ends;

(ii) a rotatable, externally drive beater/agitator mounted vertically within said tank and extending over the length of the said cylindrical tank;

(iii) fluid inlet ports extending through the said lower closed end for the introduction of the said salt solution and organic fuel; and (iv) at least one outlet port extending through the said cylindrical tank vertical wall close to an upper end of said cylindrical tank; and (d) collecting the resultant emulsion from the said blender.

2. A method as claimed in claim 1 comprising the further step of passing the collected emulsion continuously through a fine emulsification mixer to achieve further emulsification and to improve the sensitivity of the explosive.

3. A method as claimed in claim 2 wherein the said fine emulsification mixer is an in-line static mixer.

4. A method as claimed in claim 2 wherein the said fine emulsification mixer comprises an adjustable orifice.

* * * * *